US010436549B1

(12) United States Patent
Taylor et al.

(10) Patent No.: US 10,436,549 B1
(45) Date of Patent: Oct. 8, 2019

(54) RIFLE HANDGUARD SYSTEM

(71) Applicant: 5TH AXIS, INC., San Diego, CA (US)

(72) Inventors: Chris Taylor, Encinitas, CA (US); Robert Davies, San Diego, CA (US)

(73) Assignee: 5TH AXIS, INC., San Diego, CA (US)

( * ) Notice: Subject to any disclaimer, the term of this patent is extended or adjusted under 35 U.S.C. 154(b) by 0 days.

(21) Appl. No.: 16/292,661

(22) Filed: Mar. 5, 2019

Related U.S. Application Data

(60) Provisional application No. 62/739,865, filed on Oct. 2, 2018.

(51) Int. Cl.
*F41C 23/16* (2006.01)
*F41A 3/66* (2006.01)

(52) U.S. Cl.
CPC ..... *F41C 23/16* (2013.01); *F41A 3/66* (2013.01)

(58) Field of Classification Search
CPC ..... F41C 23/16; F41A 3/66
USPC ..... 42/72, 71.01, 75.03
See application file for complete search history.

(56) References Cited

U.S. PATENT DOCUMENTS 7,770,317 B1 8/2010 Tankersley
8,904,691 B1 * 12/2014 Kincel ..... F41C 23/16 42/71.01
9,003,686 B2 4/2015 Brown
9,303,949 B1 * 4/2016 Oglesby ..... F41A 3/66
9,453,694 B1 * 9/2016 Storch ..... F41A 3/64
9,464,865 B2 * 10/2016 Shea ..... F41C 23/16
9,683,808 B2 6/2017 Gagnon
9,776,036 B1 9/2017 Daley, Jr.
9,791,239 B1 10/2017 Kincel et al.
10,145,648 B1 12/2018 Holder et al.
2014/0196338 A1 * 7/2014 Lessard ..... F41A 3/66 42/16
2016/0091276 A1 3/2016 Miller et al.
2017/0160048 A1 6/2017 Galletta, II
2017/0343315 A1 11/2017 Beaty et al.
2018/0119721 A1 5/2018 Gomez
2018/0195832 A1 7/2018 Faxon
2018/0202757 A1 * 7/2018 Samson ..... F41C 23/16
2019/0170476 A1 * 6/2019 Hiler, Jr. ..... F41C 23/16

FOREIGN PATENT DOCUMENTS

CA 2877197 A1 * 7/2015 ..... F41C 23/16

* cited by examiner

*Primary Examiner* — Jonathan C Weber
(74) *Attorney, Agent, or Firm* — Mark Wisnosky

(57) ABSTRACT

An improved handguard for AR type rifles is shown. The handguard system uses an offset cam with a dual tapered side surface that engages a tapered circumferential groove on the barrel nut. Tightening the cam in place forces the receiver end of the handguard to clamp simultaneously against the barrel nut and against the front edge of the upper receiver of the rifle.

2 Claims, 8 Drawing Sheets

100

RIFLE HANDGUARD SYSTEM

CROSS-REFERENCE TO RELATED APPLICATIONS

This application claims priority to U.S. Provisional application 62/739,865, titled Rifle handguard System, filed 2 Oct. 2018, by the same inventors.

STATEMENT REGARDING FEDERALLY SPONSORED RESEARCH OR DEVELOPMENT

Not Applicable.

BACKGROUND OF THE INVENTION

Technical Field

The present invention relates to a handguard system for a rifle that accommodates interchangeable handguards such as the AR-15 ® style rifles (AR-15 is a registered trademark of COLT'S MANUFACTURING IP HOLDING COMPANY LLC LIMITED LIABILITY COMPANY).

Related Background Art

AR-15 style rifles in various configurations are important military weapons used by the United States and elsewhere and also very popular sport rifles. The original design dates back more than 50 years. Interchangeability of parts including the handguard enable updates and new configurations that help to maintain its popularity. Attachment of the handguard to the upper receiver of the rifle is important for proper operation of the rifle. The automated firing mechanism of the rifle relies on capturing a portion of the energy released as muzzle gas. This places extra strain on the connection between the handguard and the upper receiver. Although there are a large variety of handguard designs available commercially, the attachment mechanism is still in need of improvement. Prior art systems use a multitude of parts and often rely on a friction fit between the handguard and the barrel nut. There is a need for an improved handguard system.

BRIEF DESCRIPTION OF THE DRAWINGS

Features are numbered equivalently through all drawings.

Reference numbers through all Figures refer consistently to the same parts.

DETAILED DESCRIPTION OF THE INVENTION

Figure 1:
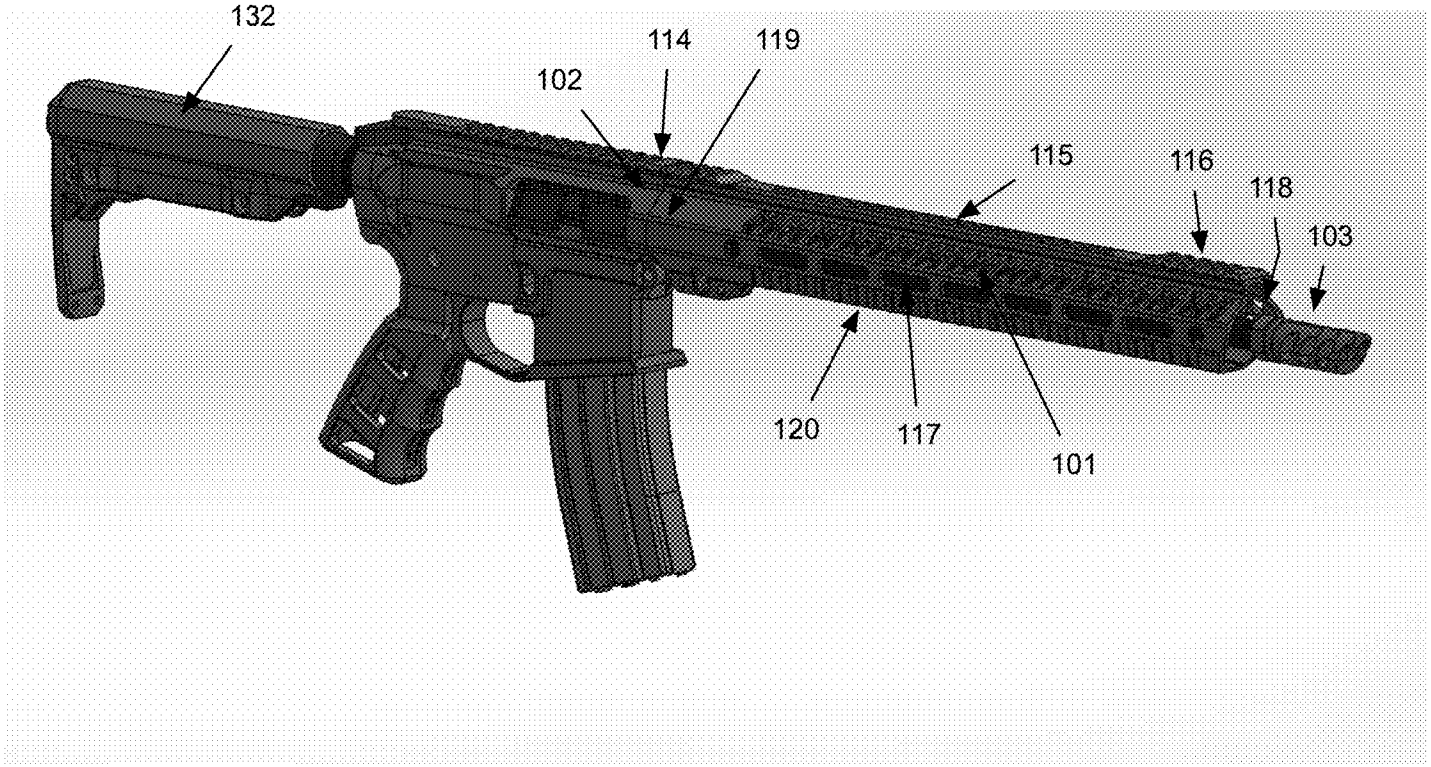
FIG. 1 shows a version of a complete rifle including the handguard system.

Referring to FIG. 1, the rifle 100 is comprised of an upper receiver 102, a butt 132, a barrel 103, and, a handguard 101 attached to the upper receiver and encasing the barrel. The handguard includes a muzzle end 118 and a receiver end 119. The barrel 103 is seen extending from the handguard 101. The handguard includes a top rail 115. A site mount 116, in a preferred mode, is attached to the top rail of the handguard 101. Attachment of the handguard to the upper receiver requires alignment of the top rail 115 of the handguard with the top rail 114 of the upper receiver. The bottom edge 120 of the handguard 101 is held by the user during use. The handguard further includes vents 117 dispersed along the side and top of the handguard to exhaust gas upon firing. A portion of the energy from the exhaust gas is routed either hydraulically or mechanically back to the receiver to actuate ejection and reloading of the chamber after firing.

Figure 2:
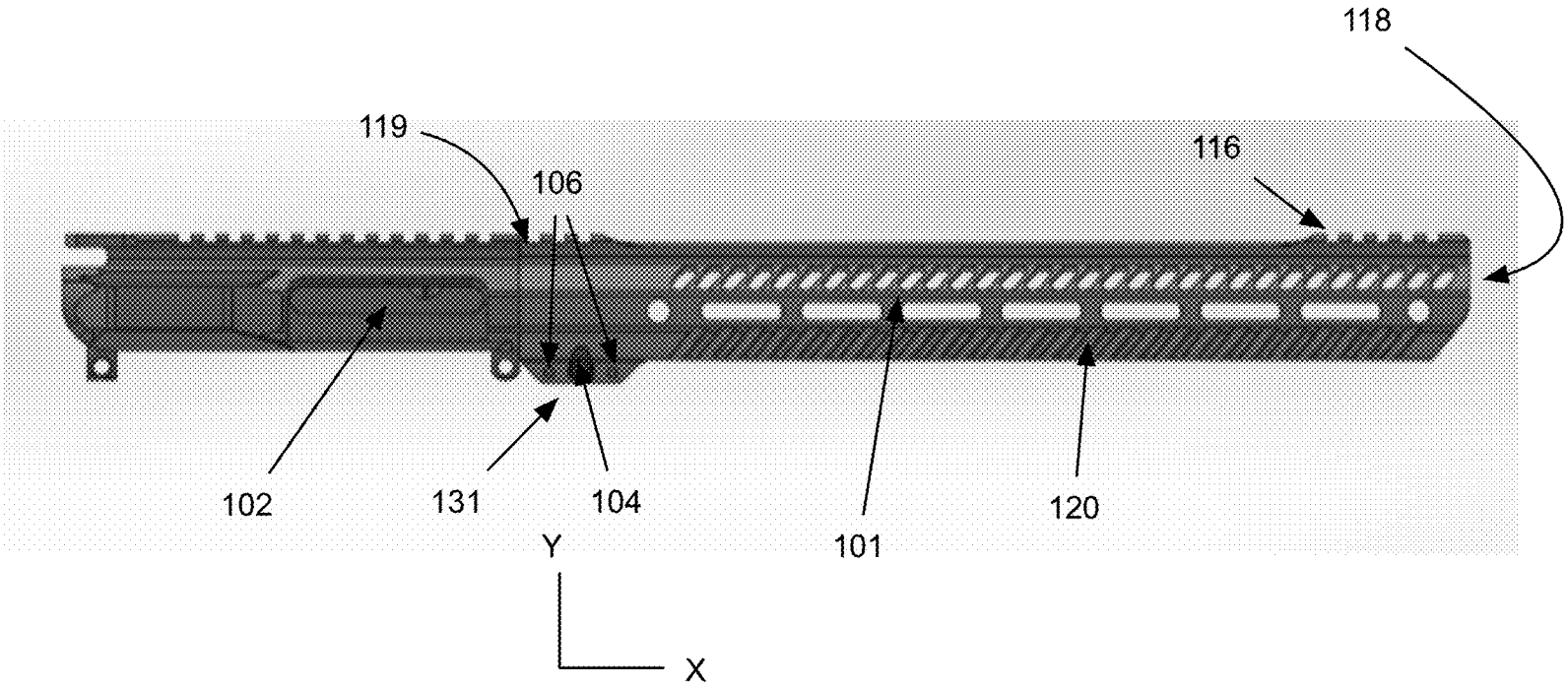
FIG. 2 shows a more detailed view of just the upper receiver and the handguard system.

FIG. 2 shows additional details of the handguard system showing only the upper receiver 102 and the handguard 101 with the rest of the parts of rifle removed. Parts, numbered consistently drawing to drawing are as already described. The receiver end 119 of the handguard 101 is attached to the upper receiver 102 of the rifle using internal parts, visible in later drawings, that are actuated using a cam 104 and a cam screw (not labeled) and additional bolts 106. In use the cam is first locked in place by turning the cam screw, and, then, the additional bolts 106 are installed. The handguard includes a tab 131 attached to the bottom edge 120 of the handguard at the receiver end 119.

Figure 3:
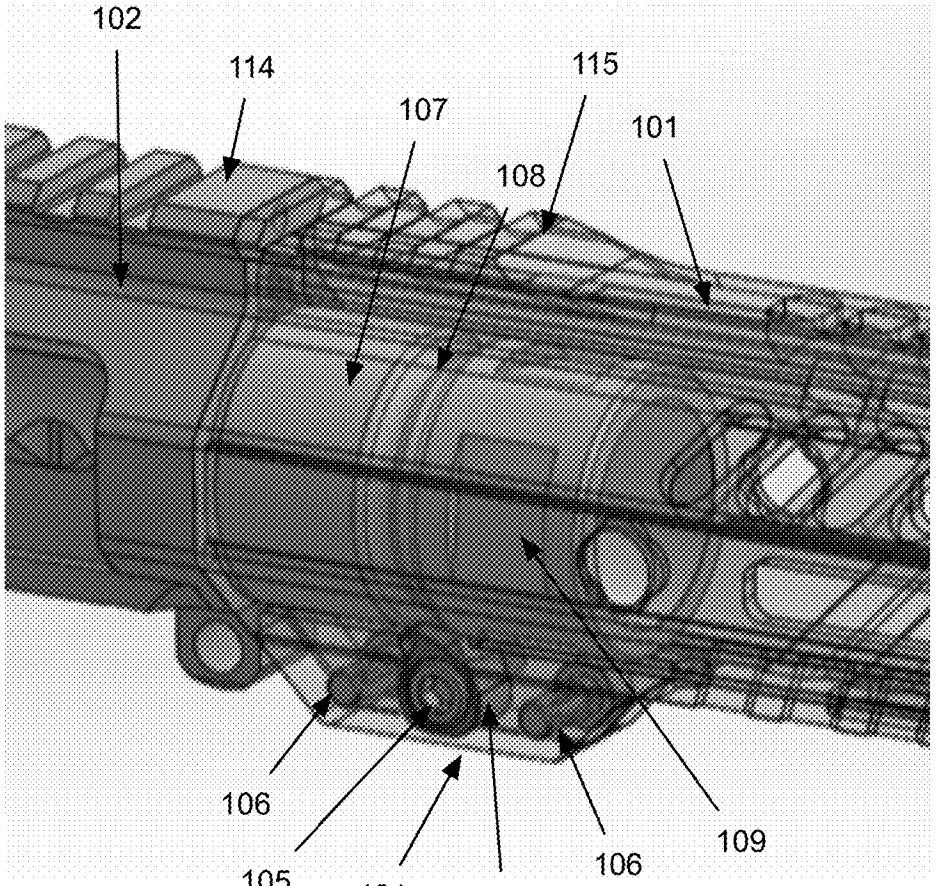
FIG. 3 shows a see-through view of the handguard, barrel nut, the upper receiver and means for connection.
Figure 4:
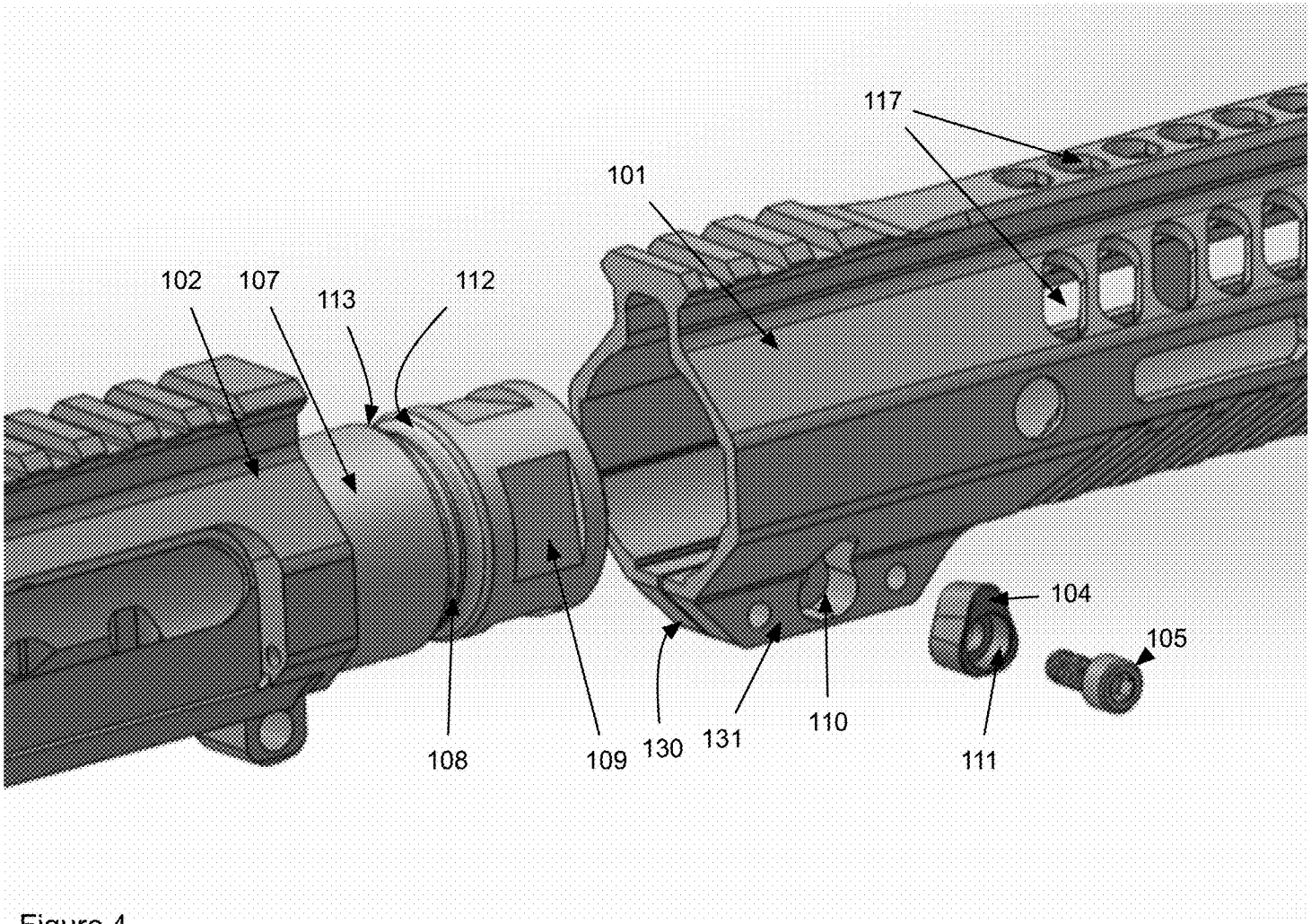
FIG. 4 shows an exploded view of the upper receiver, barrel nut and handguard system showing the cam connection system.

FIGS. 3 and 4 provide detail view of the tab. The connection between the handguard 101 and the upper receiver 102 is made through actuating the parts located in the tab 131 of the handguard. The tab is comprised of two trapezoidal shaped planar parts made of the same material and integrated into the handguard 101. The trapezoidal planar parts are separated by a slot 130 cut through the wall of the handguard. The slot is compressed by use of screws 105, 106, tightened by fitting through a first side or second side of the tab and screwing into threaded holes on the opposite side of the tab 131. The Tab has a first side, shown facing outward from the page of FIG. 3 and FIG. 4, and a second opposite side facing into the page of the Figures. The cam is fit into a similarly shaped, in profile, cutout 110 within the tab 131. The cam screw 105 passes through a hole 126 in the cam, then through the first side of the tab 131 and fits into a threaded hole on the near face of the second side of the tab.

The handguard system further includes a barrel nut 107 that is secured in place when the barrel (not shown) is installed in a manner well known in the art. The cam 104 engages a groove 108 on the barrel nut 107 as the cam screw 105 is turned. The cam 104 includes a taper on a first side surface that engages a front edge of the groove on the barrel nut and forces the handguard back towards the upper receiver 102 thereby pressing the handguard against the upper receiver. Once the cam screw is tightened and the handguard pressed into place, additional screws 106 are then tightened that compress the slot 130 and handguard in place (best seen in FIG. 4).

Figure 5:
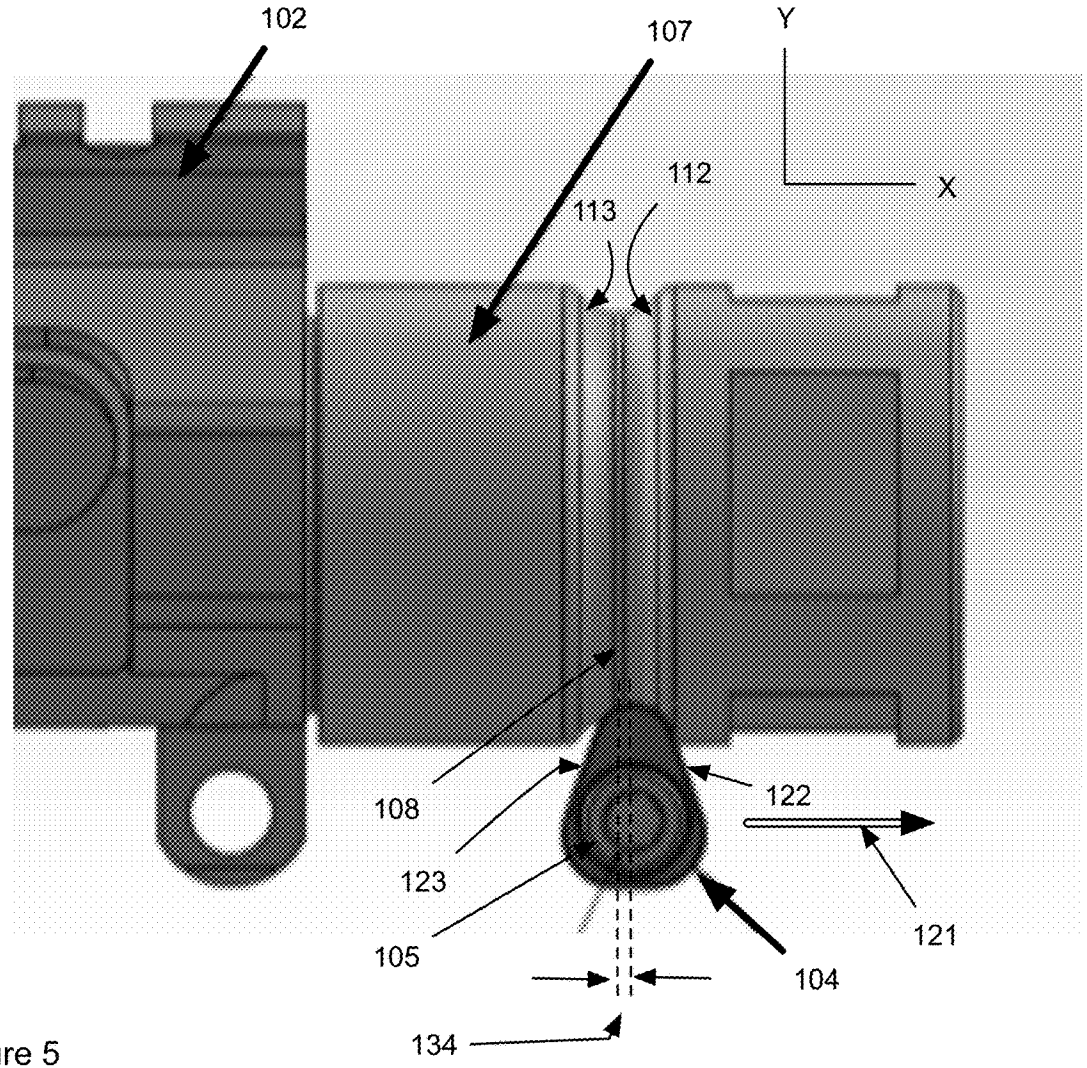
FIG. 5 shows a side view of the cam connection system.
Figure 6:
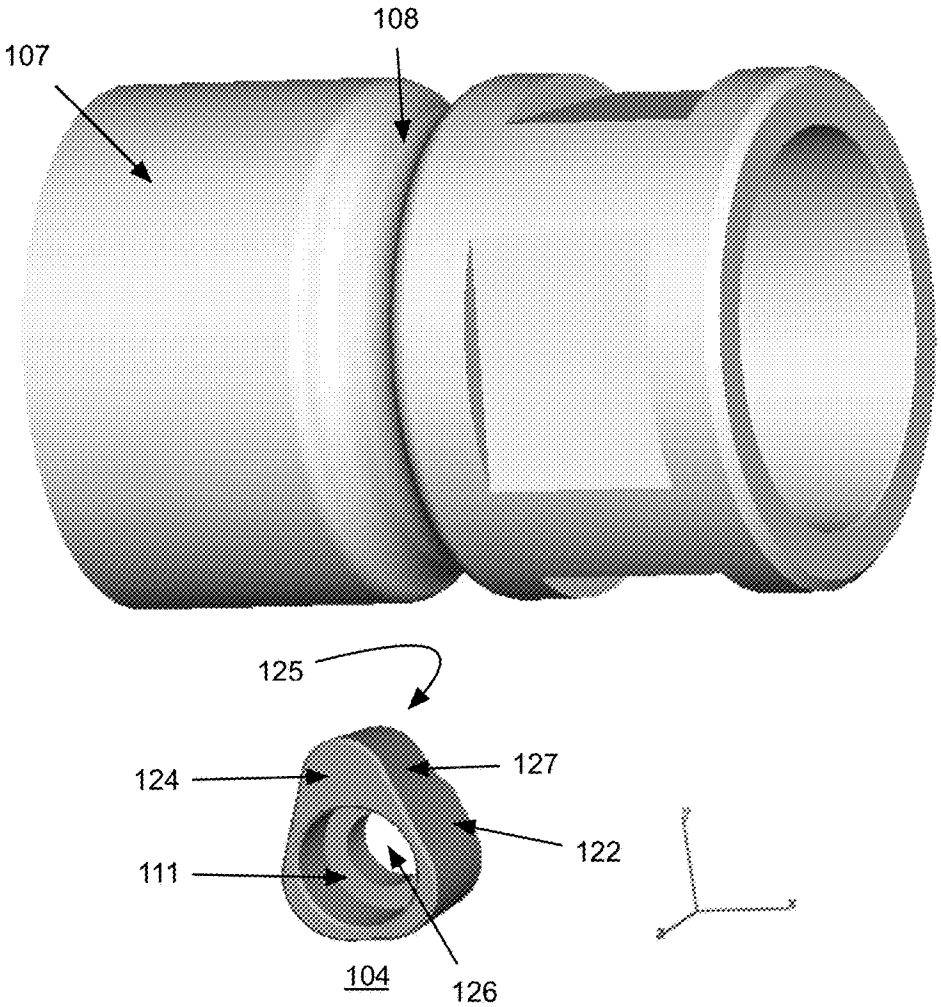
FIG. 6 shows additional detail of the cam and the barrel nut.

FIG. 4 shows an explode view of the clamping region of the handguard. The handguard 101 fits over the barrel nut 107. The barrel nut includes a groove 108 having a front angled surface 112 and a back angles surface 113. The barrel nut, in the example shown, further includes flats 109 used to engage a tool to tightened the barrel nut in place. Other means for engaging a tool as are known in the art, may also be used. Once the handguard 101 is fit over the barrel nut 107, the cam 104 is inserted into a cutout 110 shaped and sized to accommodate the cam and the cam screw 105 is inserted through a hole 126 (see FIG. 6) in the cam to engage a threaded hole located on the opposite side of the tab region 131. See FIGS. 5-8 for details of parts and the cam engagement with the barrel nut. The cam includes a cutout 111 such that once tightened the head of the cam screw 105 is flush with the surface of the tab region 131. As the cam screw is tightened a first side surface 122 of the cam 104 engages a first surface 112 of the groove in the barrel nut. The first side surface 122 includes a tapered region 127 that presses against surface 112 on the barrel nut groove 108 forcing a clamping in the Y direction as well as simultaneously pushing the handguard 101 in the negative X direction and pressing the handguard against the upper receiver. As seen in FIG. 5 the cam when located within the cutout 111 is offset 121 in the X direction 121 relative to the location of the circumferential groove 108. The axes are shown in the drawing and refer to a right handed axes system with the positive X direction along the barrel of the rifle, the Y-Direction vertical, and the positive Z-direction therefore coming out of the page of the drawings. Therefore, tightening the cam screw 105 moves the cam in the negative Z-direction and thereby apples forces to move the receiver end 119 of the handguard in both the negative Y-direction to clamp against the barrel nut and the negative X-direction to clamp against the upper receiver. Referring to FIG. 6, the cam 104 is a triangular shaped three-dimensional solid having a front surface 124 and a back surface 125. A first side surface 122 of the cam includes a tapered region 127 that engages the first side surface 112 of the groove 108. The hole 126 for the cam screw and the cutout 111 for the head of the cam screw are also more clearly seen in this FIG. 6.

Figure 7:
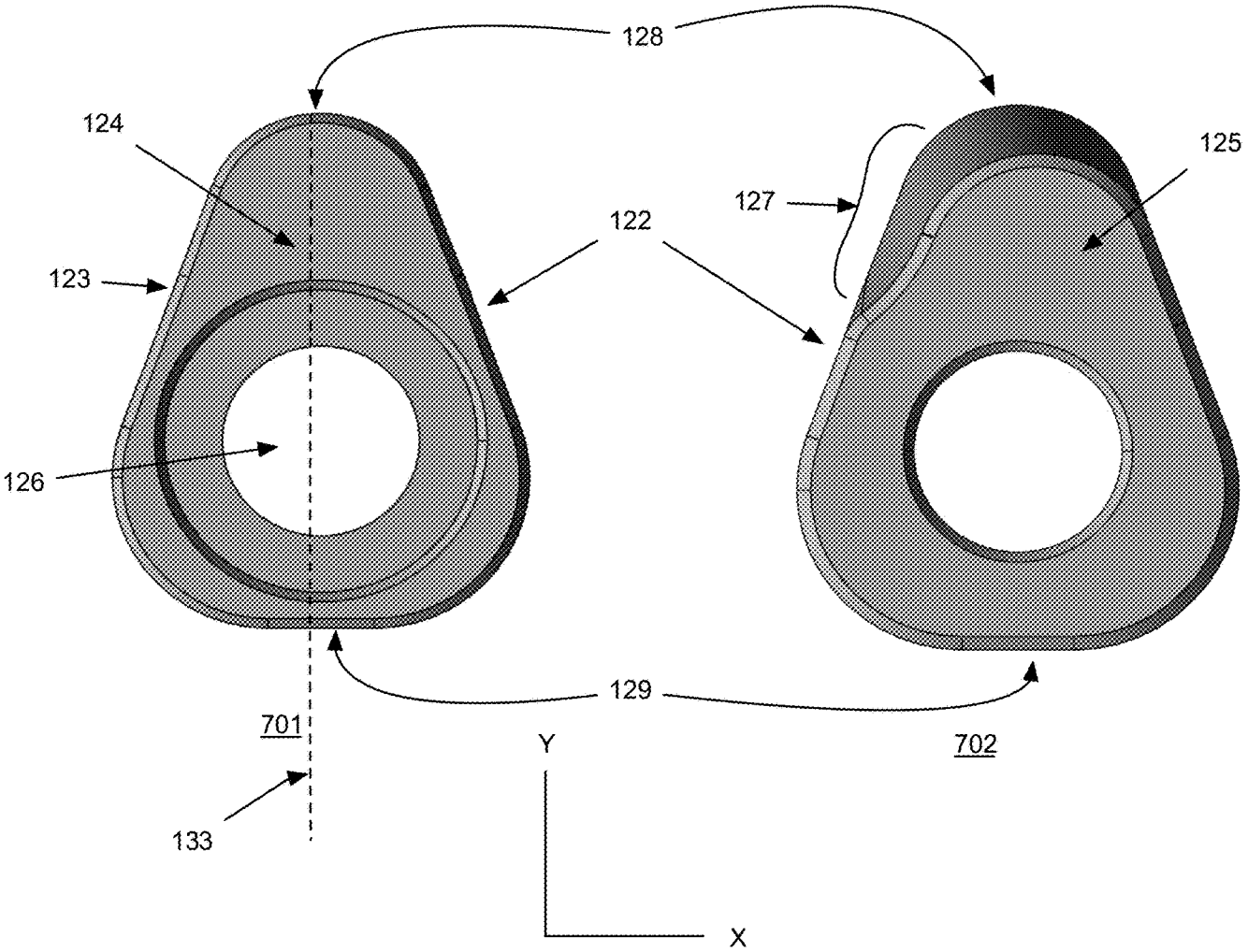
FIG. 7 shows front and back views of the cam.
Figure 8:
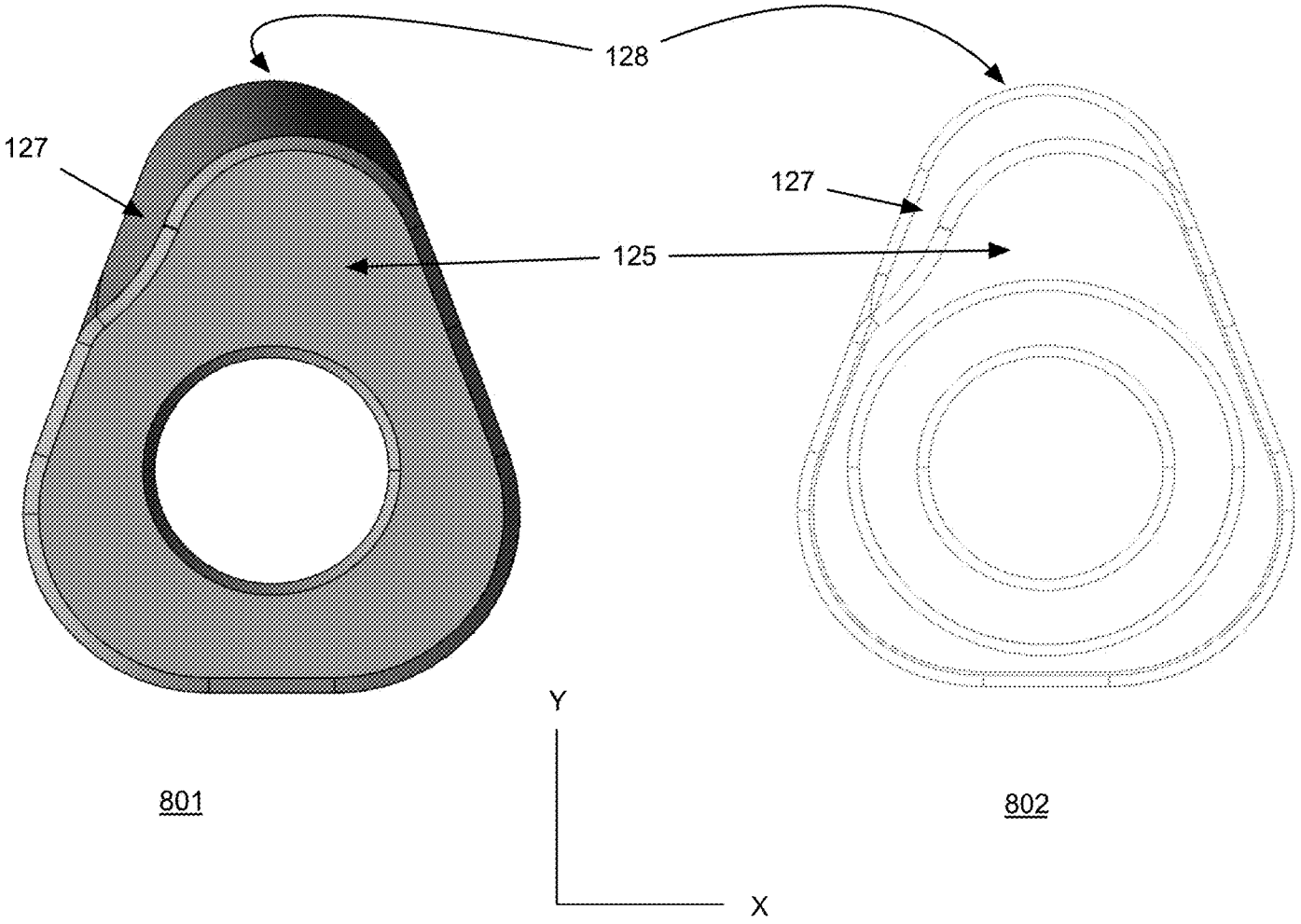
FIG. 8 shows two back views of the cam, one a solid view rendering and the other a wire frame rendering.

Additional details of the cam 104 are seen in FIGS. 7 and 8. The view 701 shows the front surface 124 of the cam and the view 702 shows the back 125 surface of the cam. The front surface of the cam includes a vertical center of symmetry. When the cam is mated against the groove 108 the center of symmetry of the cam 133 is offset from the center of the groove 108. Tightening the cam screw 105 then moves the handguard in the negative x direction to decrease the offset and thereby clamp the handguard against the receiver. The offset 134 is seen in FIG. 5. The cam includes a top 128 and a bottom 129 and two side surfaces 122, 123. The first side surface 122 includes a taper region 127 that is tapered from front 124 to back 125 at both the top 128 of the cam and along the first side 122 of the cam. It is the taper region 127 that engages the first side 112 of the groove 108 located in the barrel nut 107. The taper region 127 of the first side 122 of the cam is best seen in the two back views of the cam seen in FIG. 8. The first view 801 is a solid rendering of the cam and the second view 802 is a wire frame rendering of the perspective of the cam.

SUMMARY

An improved handguard for AR type rifles is shown. The handguard system uses an offset cam with a dual tapered side surface that engages a tapered circumferential groove on the barrel nut. Tightening the cam in place forces the receiver end of the handguard to clamp simultaneously against the barrel nut and against the front edge of the upper receiver of the rifle.

Those skilled in the art will appreciate that various adaptations and modifications of the preferred embodiments can be configured without departing from the scope and spirit of the invention. Therefore, it is to be understood that the invention may be practiced other than as specifically described herein, within the scope of the appended claims.

What is claimed is:

1. A handguard system for a rifle having an upper receiver, the handguard system comprising:

a) a handguard body including a tab extended from a bottom edge at a receiver end of the handguard body, the tab including a cutout to the side and shaped to receive a triangular shaped cam, and, b) the triangular shaped cam having a front surface, a back surface, a top and a bottom, and a first side surface and a second side surface and a hole extending from the front surface through the back surface for receiving a cam screw, and, a center of symmetry located vertically in the front surface, and, the first side surface having a tapered region at the top, the tapered region being tapered from the front surface to the back surface along two axes, and, c) a barrel nut having a circumferential groove, the circumferential groove having a first tapered surface and a second tapered surface, and, the center of symmetry of the front cam surface is offset from the center of the groove when the handguard is fit over the barrel nut and the cam is inserted in the cutout, and, d) when the handguard body is fit over the barrel nut and the cam screw is inserted through the hole, engaging a threaded hole in the tab, and, tightened, the tapered region of the cam engages the first tapered surface of the groove and causes the body of the handguard to simultaneously be pressed against the barrel nut and against the upper receiver thereby aligning and securing the handguard body against the upper receiver of the rifle.

2. A triangular shaped cam used in securing a handguard to a barrel nut, the barrel nut having a circumferential groove, and, a) the cam having a front surface, a back surface, a top and a bottom, and a first side surface and a second side surface and a hole extending from the front surface through the back surface for receiving a cam screw, and, a center of symmetry located vertically in the front surface, and, the first side surface having a tapered region at the top, the tapered region being tapered from the front surface to the back surface along two axes, and, b) the circumferential groove having a first tapered surface and a second tapered surface, and, the center of symmetry of the front cam surface is offset from the center of the groove when the handguard is fit over the barrel nut and the cam is inserted in the cutout, and, c) the tapered region of the cam engages the first tapered surface of the groove and causes the handguard to simultaneously be pressed against the barrel nut and against an upper receiver of a rifle to which the barrel nut is attached, thereby aligning and securing the handguard against the upper receiver of the rifle.

* * * * *